US008297953B2

(12) United States Patent
Wu

(10) Patent No.: US 8,297,953 B2
(45) Date of Patent: Oct. 30, 2012

(54) MINI PUMP

(76) Inventor: Scott Wu, Taichung Hsien (TW)

( * ) Notice: Subject to any disclaimer, the term of this patent is extended or adjusted under 35 U.S.C. 154(b) by 366 days.

(21) Appl. No.: 12/203,212

(22) Filed: Sep. 3, 2008

(65) Prior Publication Data

US 2010/0054962 A1 Mar. 4, 2010

(51) Int. Cl.
*F04B 19/02* (2006.01)
*F04B 53/12* (2006.01)

(52) U.S. Cl. ..... 417/467; 417/234; 417/552

(58) Field of Classification Search ..... 417/467, 417/469, 481, 234, 466, 525, 527, 528, 254, 417/258, 259, 265, 268, 460, 468, 523, 552, 417/553, 554, 567; 92/58.1
See application file for complete search history.

(56) References Cited

U.S. PATENT DOCUMENTS 1,361,758 A * 12/1920 Ewald ..... 285/248
6,017,201 A * 1/2000 Yang ..... 417/454
6,325,601 B2 * 12/2001 Wu ..... 417/469
6,716,006 B2 * 4/2004 Yang ..... 417/528
6,736,618 B2 * 5/2004 Wu ..... 417/554
6,893,232 B2 * 5/2005 Wu ..... 417/547
2005/0146113 A1 * 7/2005 Anderson et al. ..... 280/288.4

FOREIGN PATENT DOCUMENTS

TW I 267582 12/2006

* cited by examiner

*Primary Examiner* — Devon Kramer
*Assistant Examiner* — Bryan Lettman
(74) *Attorney, Agent, or Firm* — Alan Kamrath; Kamrath IP Lawfirm, PA

(57) ABSTRACT

A mini pump has a head including a connective end, a nozzle and an air channel communicating the connective end with the nozzle. A cylinder assembly is removably engaged with the connective end of the head. A tube is selectively received in the cylinder assembly and has an end connected to the connective end. The head is locked to the cylinder assembly and the tube is concealed in the cylinder assembly when the head is in a first position. The head is disengaged from the cylinder assembly and the tube extends out of the cylinder assembly when the head is in a second position.

9 Claims, 11 Drawing Sheets

MINI PUMP

BACKGROUND OF THE INVENTION

1. Field of the Invention

The present invention relates to a mini pump. In particular, the present invention relates to a mini pump which includes a head and a cylinder assembly, with the head provided to either fix with or extend from the cylinder assembly.

2. Description of the Related Art

Mini pumps are effortless to carry. However, the volume of the mini pump is usually too small to be held easily for applying force while inflating.

The conventional mini pump still needs improvement. Taiwan Patent NO. 1267582 discloses a pump including a cylinder, a nozzle connected to an end of the cylinder, a piston positioned in the cylinder, a rod connected to the piston, a ring installed at an opposite end of the cylinder, a connector connected to the rod and a handle for connection to the connector. In an active position, the handle extends beyond the cylinder, and in an idle position, the handle shields the cylinder.

The nozzle includes a head portion and a holding portion, with the holding portion adapted for holding to operate. However, the head portion and the holding portion are integrated to each other, so that users can not adjust the distance between the cylinder and thing that is desired to to be inflated.

SUMMARY OF THE INVENTION

According to the present invention, a mini pump includes a head, a tube and a cylinder assembly. The tube connects to the head and is selectively received in the cylinder assembly. While the head is in a first position, the head is locked to the cylinder assembly, and the tube is concealed in the cylinder assembly. Thus, the whole pump is light and convenient for rapid operation. While the head is in a second position, the head is operated to detach from the cylinder assembly, and the tube is driven to extend from the cylinder assembly. Thus, hands of the user can keep a desired distance from things that are going to be inflated such as a tire.

Other objectives, advantages, and features of the invention will become more apparent from the following detailed description when taken in conjunction with the accompanying drawings.

BRIEF DESCRIPTION OF THE DRAWINGS

The present invention will be described via detailed illustration of the preferred embodiment referring to the drawings.

Figure 1:
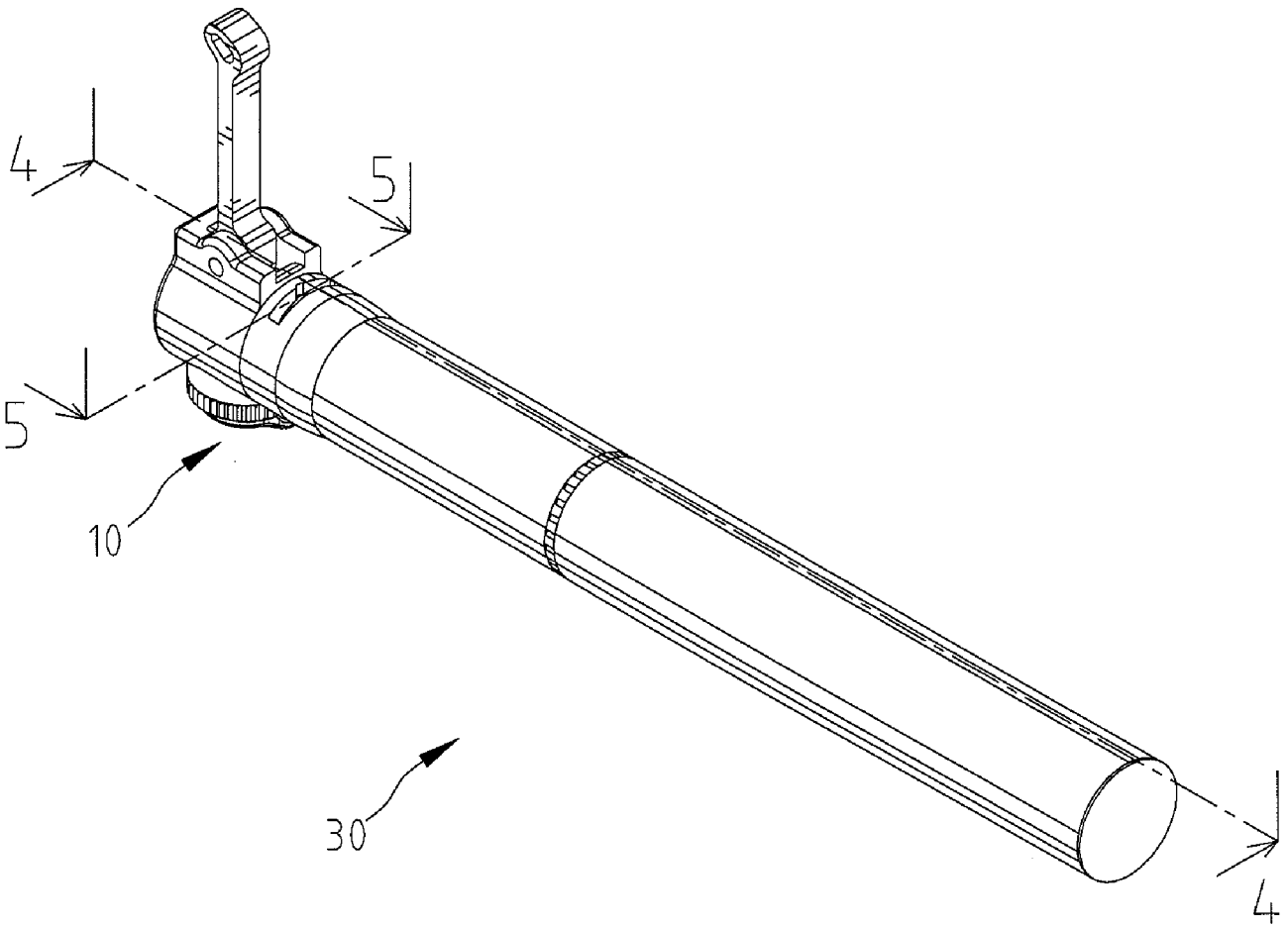
FIG. 1 is a perspective view of a mini pump in accordance with the present invention.

Where used in the various figures of the drawings, the same numerals designate the same or similar parts. Furthermore, when the terms "first", "second", "end", "area", "section", "radial", "outward", "peripheral", "depth", "length", "diameter", and similar terms are used herein, it should be understood that these terms have reference only to the structure shown in the drawings as it would appear to a person viewing the drawings and are utilized only to facilitate describing the invention.

DETAILED DESCRIPTION OF THE PREFERRED EMBODIMENT

Figure 2:
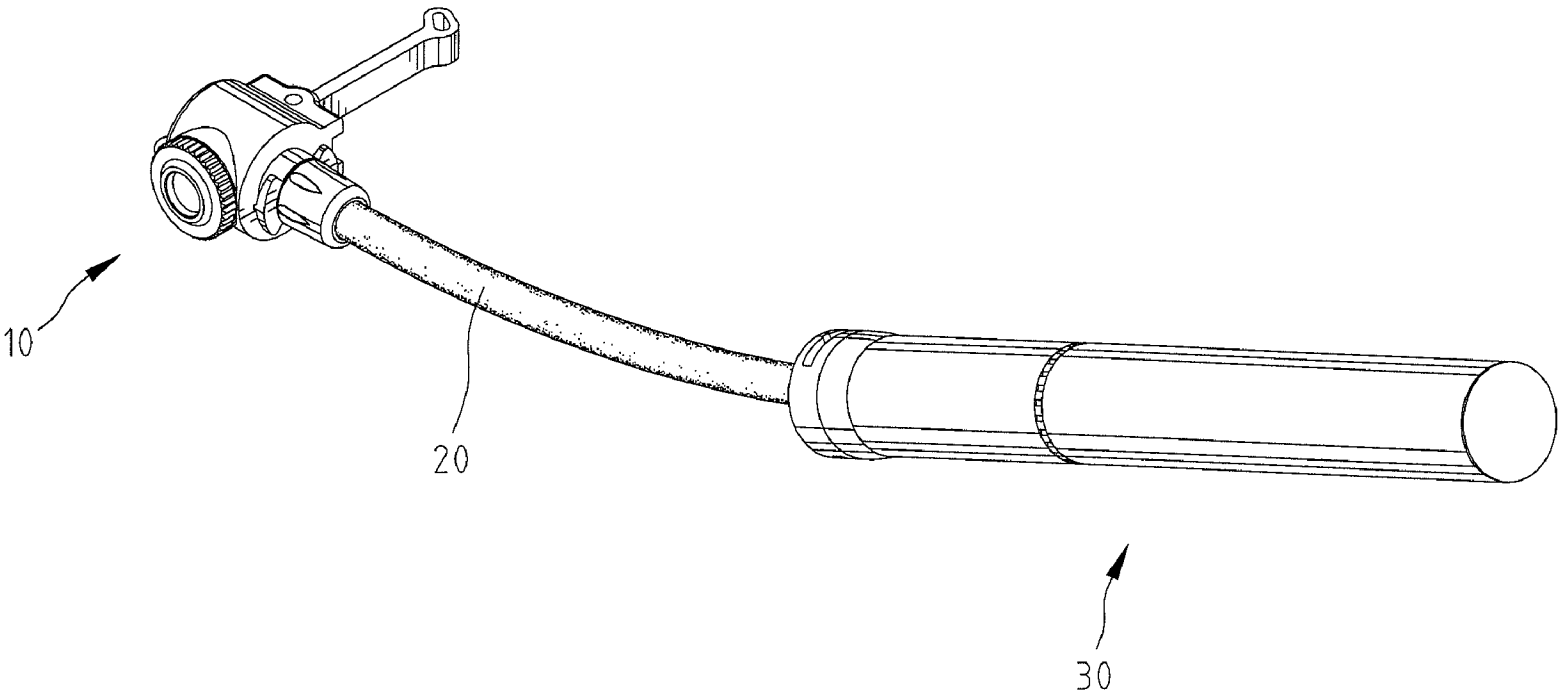
FIG. 2 is another perspective view of the mini pump in FIG. 1, illustrating the head of the mini pump drawn out of the cylinder assembly of the mini pump.

Referring to FIGS. 1 and 2, a mini pump includes a head 10, a tube 20 and a cylinder assembly 30. The tube 20 is connected to the head 10 and selectively received in the cylinder assembly 30. Air is driven to enter into the head 10 through the tube 20 via pumping up the cylinder assembly 30. As shown in FIG. 1, the head 10 is attached with an end of the cylinder assembly 30, with the whole tube 20 in a concealed position. As shown in FIG. 2, the head 10 is driven to rotate relative to the cylinder assembly 30 for detaching from the cylinder assembly 30, and the tube 20 is in an exposed position, with the tube 20 being selectively exposed from the cylinder assembly 30.

Figure 3:
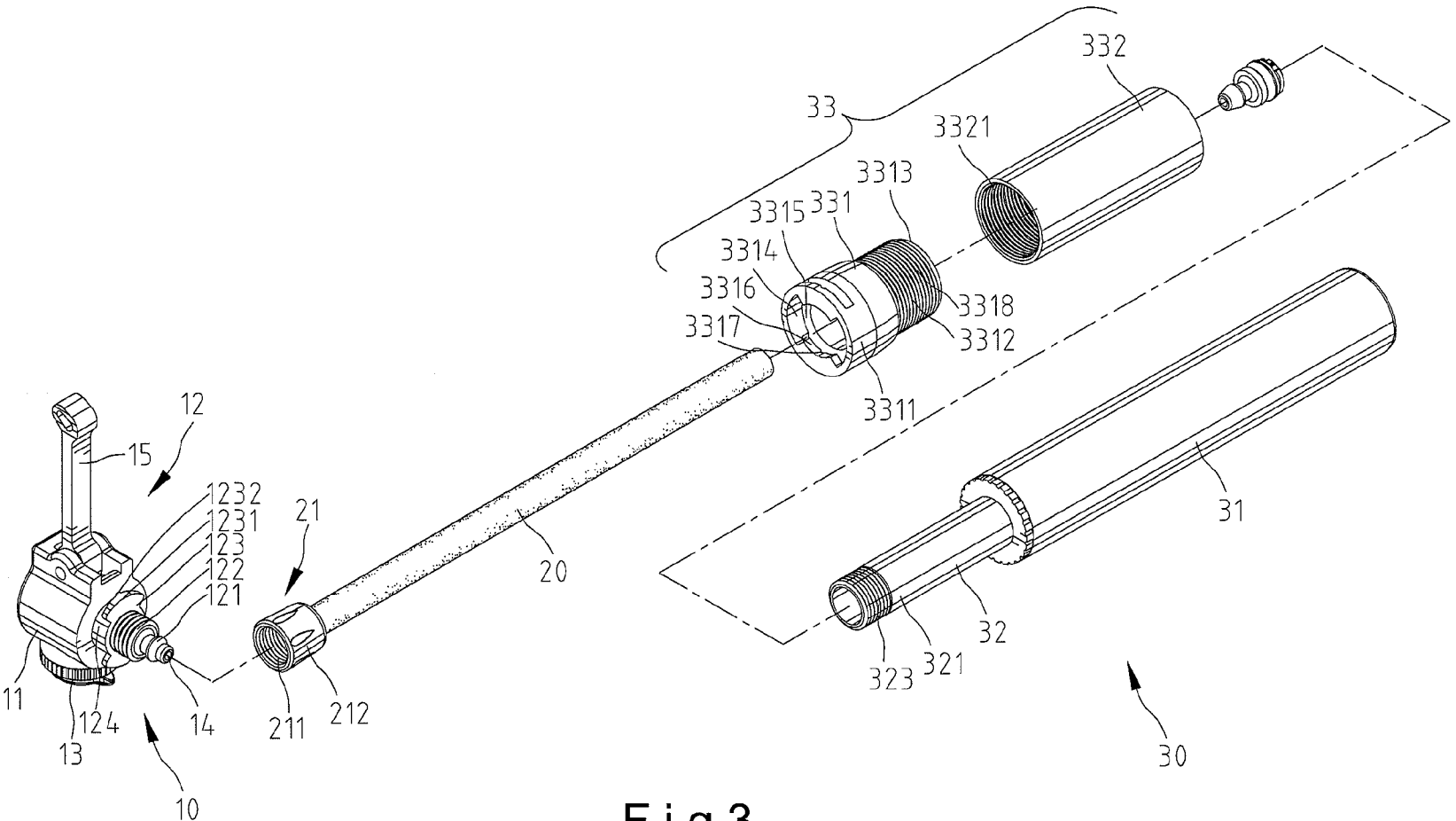
FIG. 3 is an exploded view of the mini pump in FIG. 1.
Figure 4:
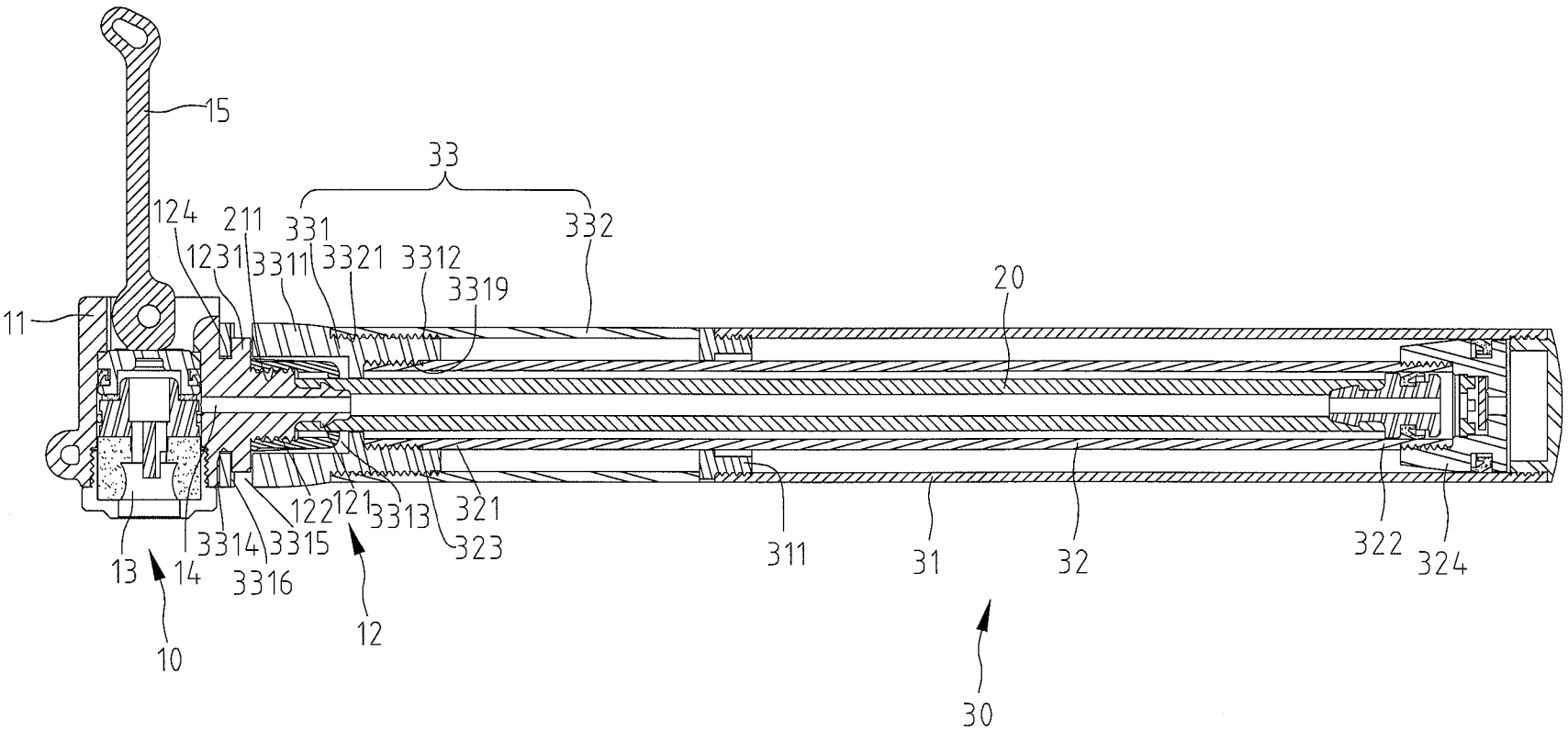
FIG. 4 is a cross-sectional view taken along 4-4 in FIG. 1, illustrating the controlling portion of the head being in the first position.

Referring to FIGS. 3 and 4, the head 10 includes a main body 11 having a first side and a second side, a handling end 15 installed on the first side of the main body 11 and a nozzle 13 disposed on the second side of the main body 11. The handling end 15 is able to be switched to control the nozzle 13 for allowing removal or grip of things, which are going to be inflated, such as a tire. A connective end 12 is extended from the main body 11 between the first and second sides. The connective end 12 includes an engaging portion 121 formed on the distal end thereof opposite to the main body 11. An exterior threaded portion 122 and a controlling portion 123 are provided on the connective end 12 annularly between the engaging portion 121 and the main body 11, with the exterior threaded portion 122 adjacent to the engaging portion 121. An annular groove 124 is formed on the connective end 12 annularly between the controlling portion 123 and the main body 11. Two flanges 1231 are provided to radially extend from the periphery of the controlling portion 123 as to form a non-circle controlling portion 123, with the flanges 1231 being opposite to each other. A protrusion 1232 protrudes from each flange 1231 toward the main body 11. An air channel 14 is provided in the connective end 12 and in communication with the nozzle 13.

A connective end 21 is installed to an end of the tube 20 and coupled to the connective end 12. An interior threaded portion 211 is formed in the connective end 21 and engaged with the exterior threaded portion 122 of the connective end 12, and a handhold portion 212 is formed on the outer periphery of the connective end 12. Thus, a user can grip the handhold portion 212 to engage with the interior threaded portion 211 of the connective end 21, and the, the engaging portion 121 is inserted into the tube 20. Because of the resilience of the tube 20, the engaging portion 121 can be tightly attached inside the tube 20 for preventing the tube 20 from disengaging from the head 10.

The cylinder assembly 30 includes an outer cylinder 31, an inner cylinder 32 and a handle cylinder unit 33. The inner cylinder 32 has first and second ends 321 and 322, with the second end 322 received in the outer cylinder 31, and with the first end 321 extending from the outer cylinder 31. An end of the outer cylinder 31 that is opposite to the first end 321 of the inner cylinder 32 is closed as to prevent the inner cylinder 32 from being inserted through the outer cylinder 31. A restricting portion 311 is provided in an open end of the outer cylinder 31 opposite to the closed end so that the first end 321 of the inner cylinder 32 extends from the restricting portion 311. An outer threaded portion 323 is formed on the distal of the first end 321 of the inner cylinder 32, and a piston 324 is installed to the distal of the second end 322 of the inner cylinder 32. In use, the outer cylinder 31 is adapted to reciprocate with respect to the inner cylinder 32 for inflating. The piston 324 prevents the air that resulted from pumping from escaping from the cylinder assembly 30. Moreover, the piston 324 is limited by the restricting portion 311 to avoid detachment of the inner cylinder 32 from the outer cylinder 31.

The handle cylinder unit 33 includes a limited element 331 and a sheath element 332, with the limited element 331 having first and second ends 3311 and 3312. A through-hole 3313 pierces the limited element 331 longitudinally from the first end 3311 to the second end 3312. First and second receiving portions 3314 and 3315 are formed on the first end 3311, with the shape of the first receiving portion 3314 being approximately equal to that of the controlling portion 123. Therefore, the controlling portion 123 passes freely through the first receiving portion 3314. Two limited portions 3316 are defined on two sides of the first receiving portion 3314 respectively and spaced from each other. The limited portions 3316 extend inwardly of the first end 3311 of the limited element 331. A recess 3317 is formed on each limited portion 3316. The recess 3317 located on one of the limited portions 3316 is opposite to the recess 3317 located on another limited portion 3316. Outer and inner threaded portions 3318 and 3319 are defined on the second end 3312 of the limited element, with the inner threaded portion 3319 adapted to engage with the outer threaded portion 323 of the inner cylinder 32. The sheath element 332 forms an inner threaded portion 3321 in an end thereof for engaging with the outer threaded portion 3318 of the limited element 331. During pumping, users can hold the outer cylinder 31 in one hand and hold the sheath element 332 in another hand for stable operation.

Figure 5:
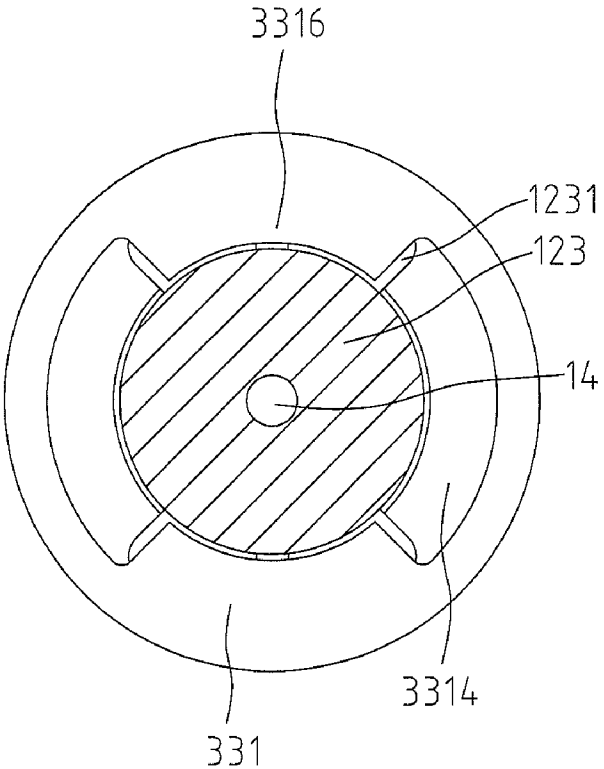
FIG. 5 is a cross-sectional view taken along 5-5 in FIG. 1, illustrating the controlling portion of the head being in the first position.
Figure 6:
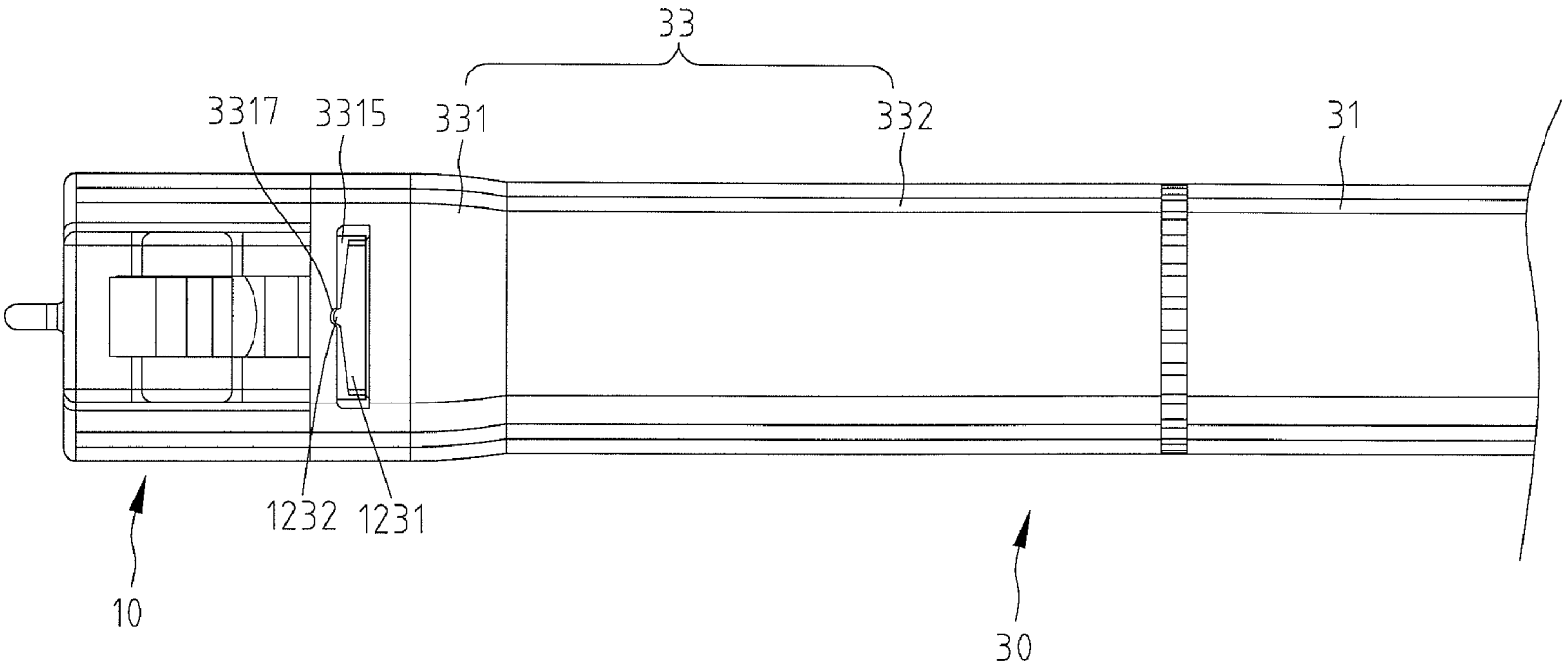
FIG. 6 is a partial, cross-sectional view of the handle cylinder unit of the mini pump in accordance with the present invention.

FIGS. 5 and 6 show the controlling portion 123 in a first position and located in the second receiving portion 3315. The flanges 1231 are abutted with the limited portions 3316 for preventing the head 10 from detaching from the handle cylinder unit 33. Further, the protrusions 1232 of the flanges 1231 engage the recesses 3317 of the limited portions 3316, respectively, as to lock the head 10 to the handle cylinder unit 33. Hence, the head 10 can not rotate with respect to the handle cylinder unit 33. Moreover, in operation of the mini pump with the head 10 in the first position, the head 10 is not easy to sway with respect to the handle cylinder unit 33 via the locking attachment of the head 10 and the handle cylinder unit 33 as to achieve a stable and rapid inflation.

Figure 8:
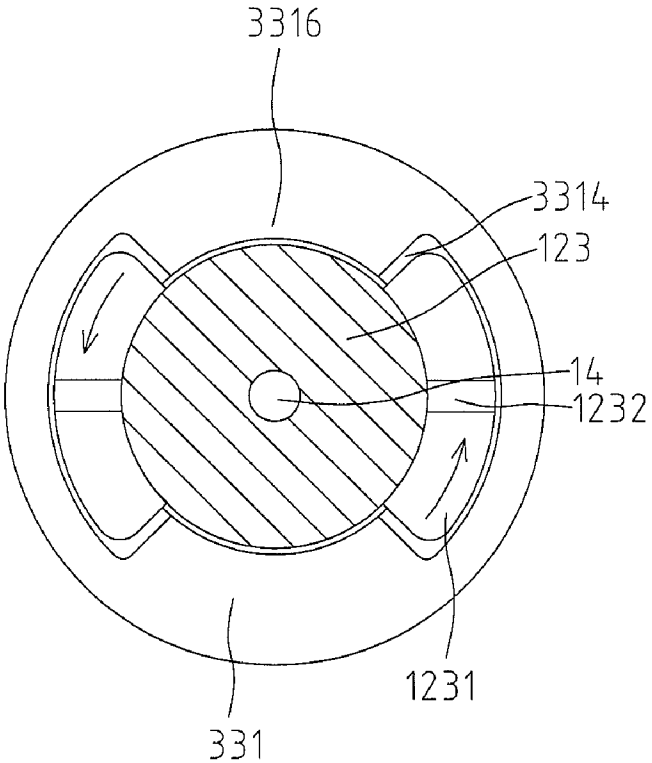
FIG. 8 is a cross-sectional view similar to FIG. 5, illustrating the controlling portion of the head being in the second position.
Figure 7:
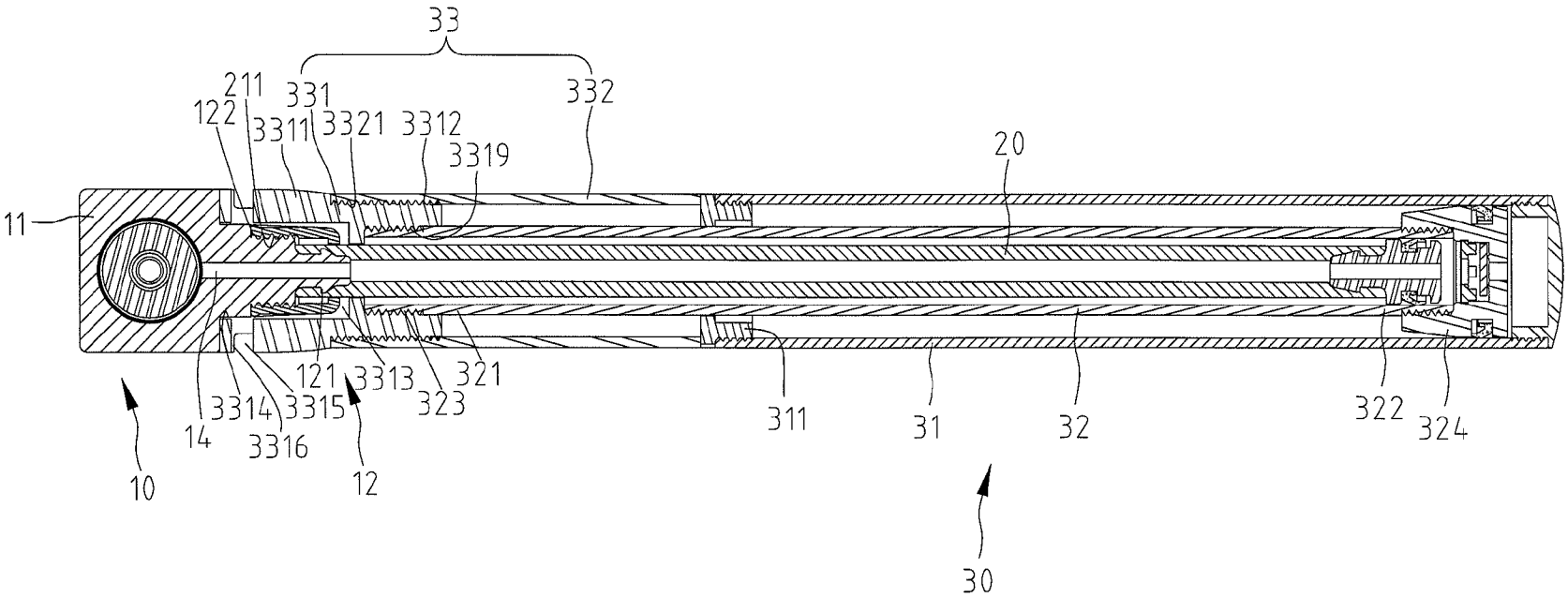
FIG. 7 is a cross-sectional view similar to FIG. 4, illustrating the controlling portion of the head being in the second position.
Figure 9:
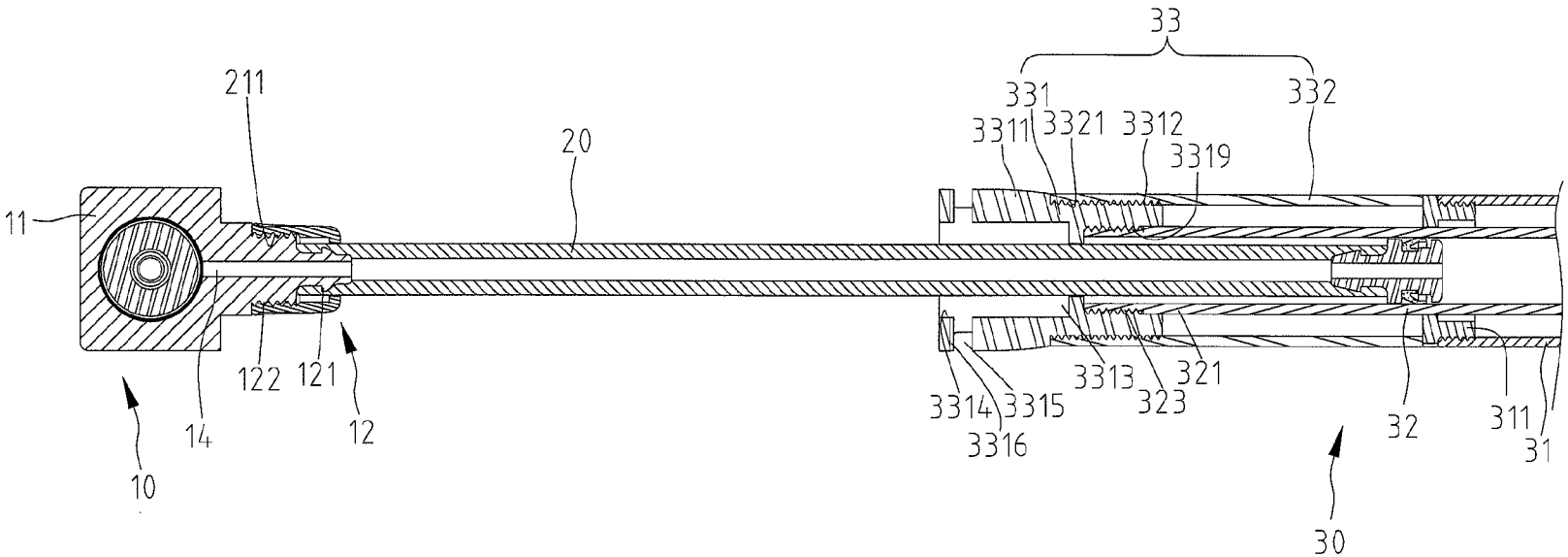
FIG. 9 is a partial, cross-sectional view similar to FIG. 7, illustrating the tube extending from the cylinder assembly.

FIGS. 7 through 9 show the controlling portion 123 in a second position. Firstly, the head 10 is slightly moved for disengaging the protrusions 1232 of the flanges 1231 from the recesses 3317 of the limited portions 3316. Secondly, the head 10 are rotated 90 degrees, and the flanges 1231 are rotated in the second receiving portion 3315 till the controlling portion 123 can pass through the first receiving portion 3314. Therefore, the controlling portion 123 detaches from the handle cylinder unit 33 of the cylinder assembly 30. With detachment of the head 10 from the cylinder assembly 30, the tube 20 extends out of the cylinder assembly 30.

Figure 10:
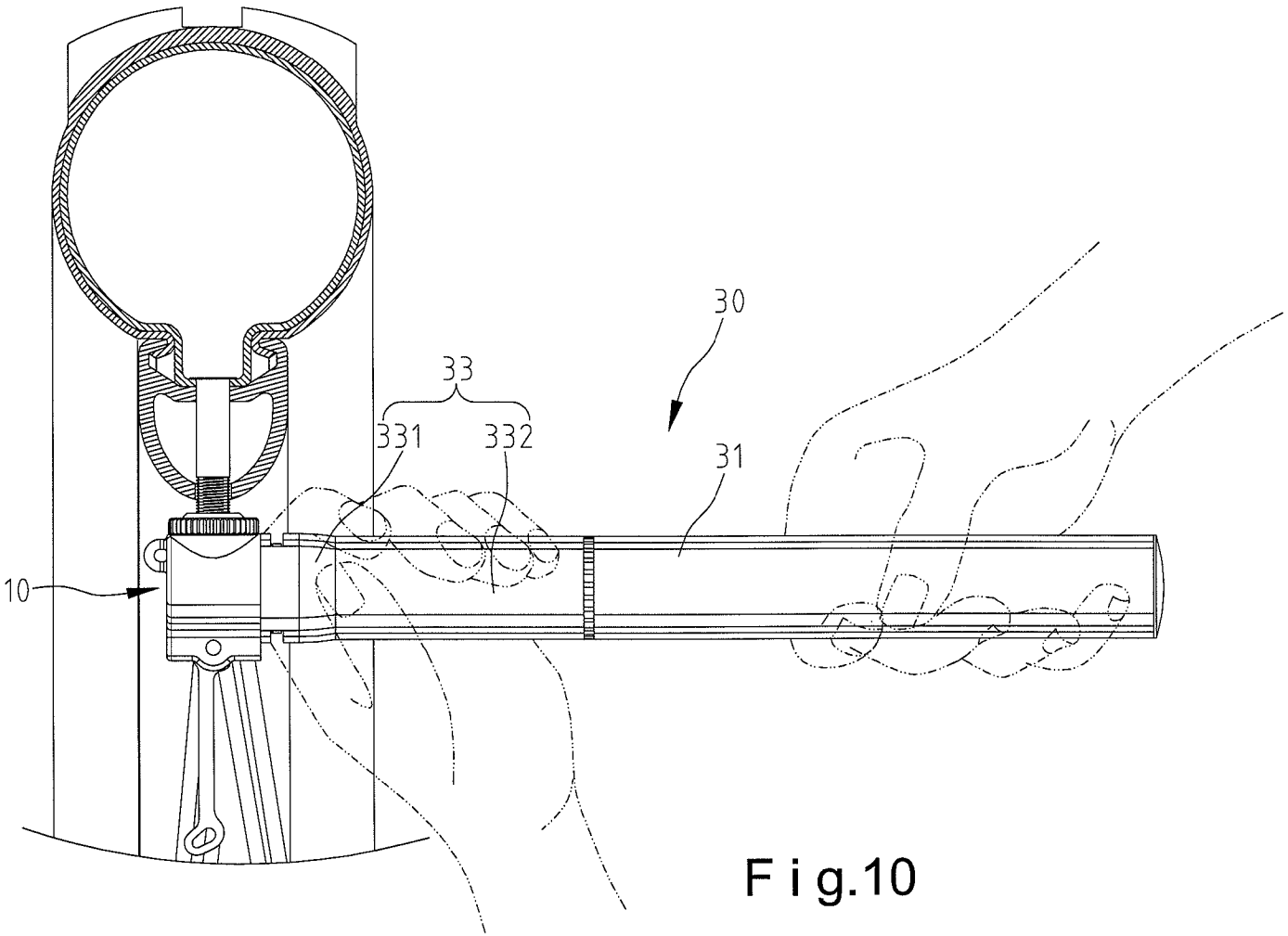
FIG. 10 is a side view of a mini pump in accordance with the present invention, illustrating that a user holds the mini pump with the head engaged with the handle cylinder unit of the cylinder assembly.
Figure 11:
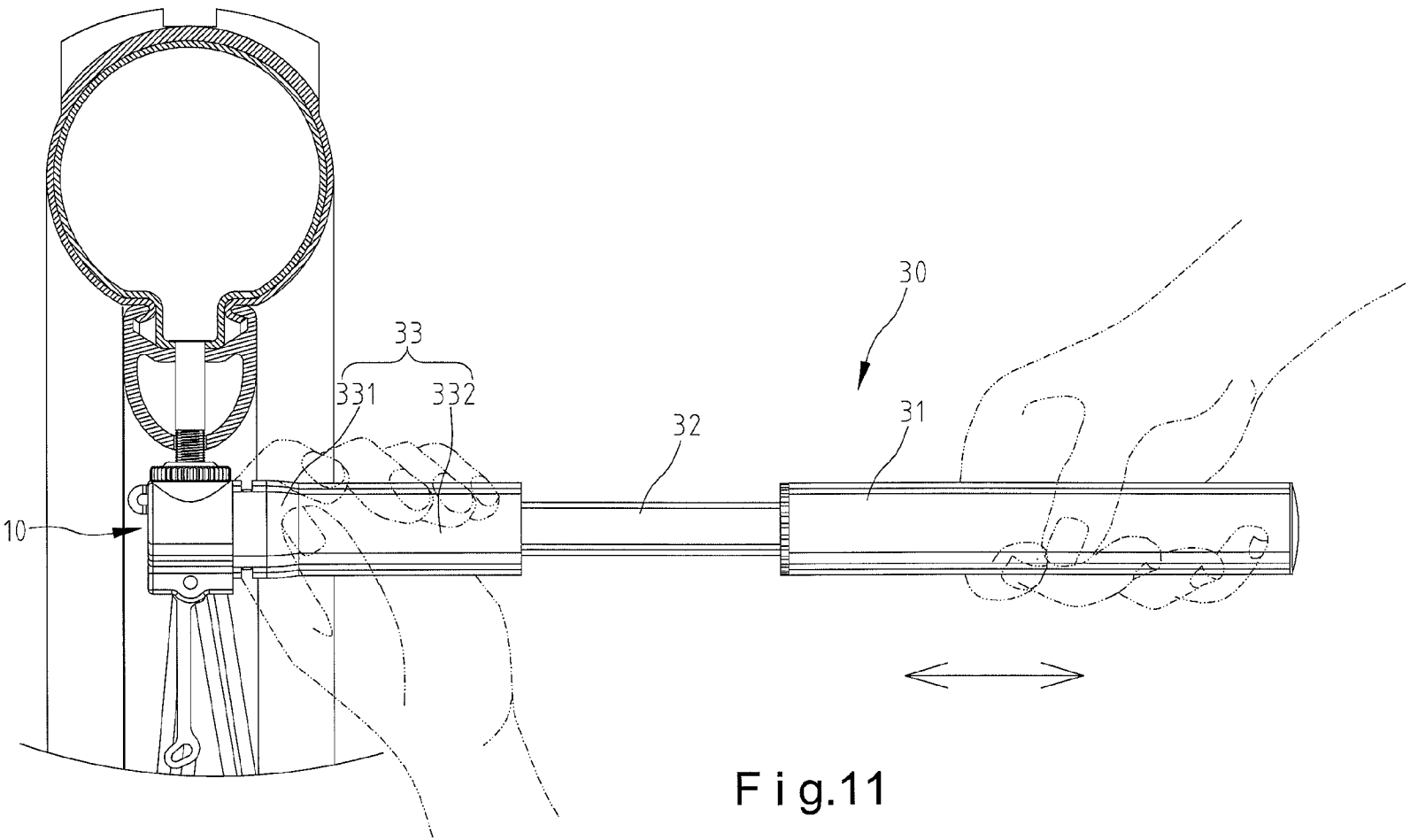
FIG. 11 is a side view of the mini pump in FIG. 10, illustrating that a user operates the mini pump with the head engaged with the handle cylinder unit of the cylinder assembly.

Referring to FIGS. 10 and 11, the controlling portion 123 of the head 10 is limited in the handle cylinder unit 33 of the cylinder assembly 30 as to attach the head 10 with the cylinder assembly 30. Users operate the cylinder assembly 30 to inflate with the controlling portion 123 in the first position. The tube 20 is concealed in the cylinder assembly 30. Thus, the mini pump is light and portable, and the volume of the mini pump is small.

Figure 12:
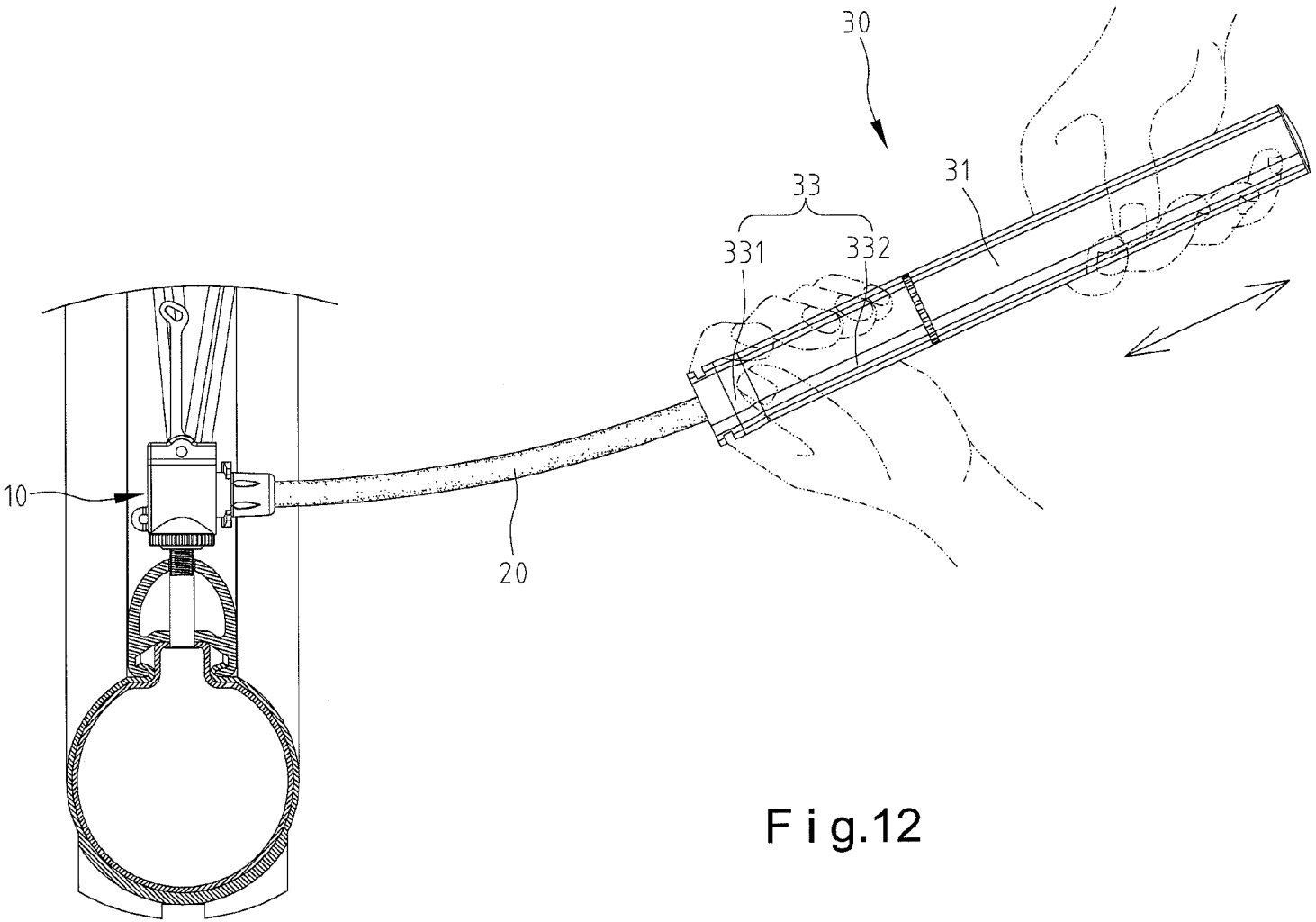
FIG. 12 is a side view of the mini pump in FIG. 10, illustrating that a user operates the mini pump with the head disengaged with the handle cylinder unit of the cylinder assembly.

Referring to FIG. 12, the head 10 is rotated 90 degrees, and the controlling portion 123 is adapted for passing through the first receiving portion 3314 of the handle cylinder unit 33 (as shown in FIG. 3) as to detach the head 10 from the cylinder assembly 30. Meanwhile, the tube 20 extends from the cylinder assembly 30, and the distance between the head 10 and the cylinder assembly 30 is adjustable via the tube 20 so that users can keep a distance from things that are going to be inflated.

While the specific embodiments have been illustrated and described, numerous modifications come to mind without significantly departing from the spirit of invention, and the scope of invention is only limited by the scope of accompanying claims.

What is claimed is:

1. A mini pump comprising:

a head including a connective end, a nozzle, an air channel communicating the connective end with the nozzle, and a handling end switchable between a removal position and a gripping position, with switching of the handling end allowing gripping or removal of things to be inflated by the nozzle;

an outer cylinder;

an inner cylinder;

a handle cylinder unit, with the inner cylinder having a first end and a second end, with the second end of the inner cylinder including a piston, with the outer cylinder reciprocally mounted on the inner cylinder, with the piston received in the outer cylinder, with the handle cylinder unit engaged with the first end of the inner cylinder, with the first and second ends of the inner cylinder being intermediate the piston and the head;

a tube received in the inner cylinder and the handle cylinder unit, with the tube being resilient, with the tube having a first end connected to the connective end and a second end slideably received in the inner cylinder with a sealed relationship; and means for locking the head to the handle cylinder unit in a first position preventing the head from detaching from the handle cylinder unit and preventing the head from rotating with respect the handle cylinder unit, with the tube concealed in the inner cylinder and the handle cylinder unit with the second end of the tube in the sealed relationship with the inner cylinder and the outer cylinder reciprocable relative to the inner cylinder when the head is in the first position; wherein the head is disengaged from the handle cylinder unit and the tube extends out of the inner cylinder and the handle cylinder unit with the second end of the tube in the sealed relationship with the inner cylinder when the head is in a second position, with the outer cylinder reciprocable relative to the inner cylinder when the head is in the second position;

wherein the handling end is switchable between the removal and gripping positions in the first position and also in the second position of the head; and wherein the mini pump has two use modes for inflating objects, with the head in the first position and the handling end switchable to control the nozzle for allowing removal or grip of said things to be inflated when the mini pump is in a first use mode, with the head in the second position and the handling end switchable to control the nozzle for allowing removal or grip of said things to be inflated when the mini pump is in a second use mode.

2. The mini pump as claimed in claim 1, wherein the locking means comprises a controlling portion formed on the connective end and first and second receiving portions provided on the handle cylinder unit; wherein when the head is in the first position, the controlling portion is limited in the second receiving portion of the handle cylinder unit to fix the head to the handle cylinder unit; wherein when the head is in the second position, the head is rotated so that the controlling portion is detached from the second receiving portion and passes through the first receiving portion to detach the head from the handle cylinder unit.

3. The mini pump as claimed in claim 2, with the controlling portion having two flanges spaced from each other, with the first receiving portion defining two limited portions spaced from each other; wherein the two flanges are able to pass through the first receiving portion when the head is in the second position; wherein the two flanges abut with the two limited portions respectively when the head is in the first position for preventing the controlling portion from detaching from the handle cylinder unit.

4. The mini pump as claimed in claim 3, further comprising two protrusions formed on the two flanges respectively and two recesses formed on the two limited portions respectively, with the two protrusions adapted to engage with the two recesses respectively when the head is in the first position.

5. The mini pump as claimed in claim 2, further comprising a main body defined on the head, with the connective end extending from the main body; wherein the head includes an annular groove provided between the connective end and the main body.

6. The mini pump as claimed in claim 5, further comprising an engaging portion formed on a distal end of the connective end opposite to the main body for connecting to the tube.

7. The mini pump as claimed in claim 6, further comprising an exterior threaded portion between the engaging portion and the controlling portion, a connective end provided on the first end of the tube and having an interior threaded portion, with the exterior threaded portion of the connective end of the head engaged with the interior threaded portion of the connective end of the tube.

8. The mini pump as claimed in claim 1, further comprising an engaging portion formed on a distal end of the connective end for connecting to the tube.

9. The mini pump as claimed in claim 1, wherein the handle cylinder unit further comprises a limited element and a sheath element mounted and engaged with the limited element, with the inner cylinder inserted through the sheath element and engaged with the limited element.

* * * * *